US008528152B1

(12) United States Patent
Hogan

(10) Patent No.: US 8,528,152 B1
(45) Date of Patent: Sep. 10, 2013

(54) MULTI-ROUNDED DESIGN FOR A CONCRETE TROWEL TO CREATE AN EDGE OR PERIMETER IN CONCRETE THAT HAS MULTI-ROUNDED DESIGNS ON THE EDGE

(76) Inventor: Gerald V. Hogan, Simi Valley, CA (US)

( * ) Notice: Subject to any disclaimer, the term of this patent is extended or adjusted under 35 U.S.C. 154(b) by 1819 days.

(21) Appl. No.: 11/373,416

(22) Filed: Mar. 9, 2006

(51) Int. Cl.
*E04F 21/16* (2006.01)

(52) U.S. Cl.
USPC ..... 15/235.4; 15/235.6

(58) Field of Classification Search
USPC ..... 15/235.4, 235.6, 236.07; 404/97
See application file for complete search history.

(56) References Cited

U.S. PATENT DOCUMENTS

| | | | | | |
|---|---|---|---|---|---|
| 166,666 | A | | 8/1875 | Walter | |
| 706,514 | A | | 8/1902 | Benninghofen | |
| 774,005 | A | * | 11/1904 | Thies | 15/235.6 |
| 1,144,891 | A | * | 6/1915 | Cannon | 15/245.1 |
| 1,168,643 | A | | 1/1916 | Johnson | |
| 1,179,170 | A | | 4/1916 | Ferguson | |
| 1,564,172 | A | * | 12/1925 | Busch | 15/235.8 |
| 1,744,097 | A | | 1/1930 | Baker | |
| 2,097,703 | A | | 10/1937 | Hitzman | |
| 2,419,167 | A | | 4/1947 | Sanford | |
| 3,045,271 | A | | 7/1962 | Cinotti | |
| 3,119,138 | A | * | 1/1964 | Davis | 15/245.1 |
| 3,123,947 | A | * | 3/1964 | Rawley | 451/495 |
| 3,274,684 | A | * | 9/1966 | Marks | 30/171 |
| 4,449,845 | A | * | 5/1984 | Carrillo | 404/118 |
| 4,669,970 | A | | 6/1987 | Perry | |
| 4,737,097 | A | | 4/1988 | Cotugno | |
| D296,294 | S | | 6/1988 | Neece | |
| 4,766,634 | A | | 8/1988 | DeVitis | |
| 4,766,635 | A | | 8/1988 | DeVitis | |
| 4,892,437 | A | * | 1/1990 | Kraft | 404/97 |
| D412,817 | S | | 8/1999 | Charland | |
| 6,415,472 | B1 | | 7/2002 | Williams | |
| 6,514,067 | B1 | * | 2/2003 | Suzuki et al. | 425/459 |
| D485,034 | S | * | 1/2004 | Anderson et al. | D32/49 |
| 7,121,762 | B2 | * | 10/2006 | Quenzi et al. | 404/84.1 |
| 7,144,193 | B1 | * | 12/2006 | Bousfield | 404/97 |
| 2008/0265127 | A1 | * | 10/2008 | Sladojevic et al. | 249/189 |

* cited by examiner

*Primary Examiner* — Laura C Guidotti
(74) *Attorney, Agent, or Firm* — Thomas I. Rozsa

(57) ABSTRACT

The present invention is a novel tool which enables a mason or concrete worker to form very beautiful decorative designs into the edge of poured concrete which is used for a driveway, walkway, border of a planter, or other concrete structure having at least a partially flat surface and at least one side edge where the decorative design is formed. Through use of the present invention, any one of a multiplicity of multi-arcuate designs are formed into at least one side edge or outside edge or inside edge of a poured concrete slab to thereby significant beautify a driveway, walkway, planter border, or any other poured concrete structure.

6 Claims, 16 Drawing Sheets

MULTI-ROUNDED DESIGN FOR A CONCRETE TROWEL TO CREATE AN EDGE OR PERIMETER IN CONCRETE THAT HAS MULTI-ROUNDED DESIGNS ON THE EDGE

BACKGROUND OF THE INVENTION

1. Field of the Invention

The present invention relates to the field of apparatus which is used to form decorative designs into poured concrete structures such as driveways, planter borders, and edges of walkways.

2. Description of the Prior Art

In general, there are many prior art appartatuses which have been used to form edges on poured concrete or masonry structures. The following Seventeen (17) patents are relevant to the field of the present invention.

1. U.S. Pat. No. 166,666 issued to William P. Walter on Aug. 10, 1875 for "Cornice Tools" (hereafter the "Walter Patent");
2. U.S. Pat. No. 706,514 issued to Ernest A. Benninghofen on Aug. 12, 1902 for "Trowel" (hereafter the "Benninghofen Patent");
3. U.S. Pat. No. 1,179,170 issued to Peter L. Ferguson on Apr. 11, 1916 for "Trowel" (hereafter the "Ferguson Patent");
4. U.S. Pat. No. 1,168,643 issued to Charles E. Johnson on Jan. 18, 1916 for "Trowel" (hereafter the "Johnson Patent");
5. U.S. Pat. No. 1,564,172 issued to Edward Harman Busch on Dec. 1, 1925 for "Cement Trowel" (hereafter the "Busch Patent");
6. U.S. Pat. No. 1,744,097 issued to John R. Baker et al. on Jan. 21, 1930 for "Mason's Molding Trowel" (hereafter the "Baker Patent");
7. U.S. Pat. No. 2,094,703 issued to August K. Hitzman on Oct. 5, 1937 for "Mortar Spreader And Process Of Spreading Mortar" (hereafter the "Hitzman Patent");
8. U.S. Pat. No. 2,419,167 issued to Cyrus Sanford on Apr. 15, 1947 for "Walking Edger" (hereafter the "Sanford Patent");
9. U.S. Pat. No. 3,045,271 issued to Julius A. Cinotti on Jul. 24, 1962 for "Universal Concrete Edger" (hereafter the "Cinotti Patent");
10. U.S. Pat. No. 3,123,947 issued to Clyde G. Rawley on Mar. 10, 1964 for "Forming Tool" (hereafter the "Rawley Patent");
11. U.S. Pat. No. 4,669,970 issued to John F. Perry on Jun. 2, 1980 for "Hand Tool For Finishing Corners And The Like With A Cementious Material" (hereafter the "Perry Patent");
12. U.S. Pat. No. 4,737,097 issued to Joseph A. Cotugno on Apr. 12, 1988 for "Concrete Slab Surface Finishing Tool" (hereafter the "Cotugno Patent");
13. U.S. Design Pat. No. Des. 296,294 issued to Roy M. Neece on Jun. 21, 1988 for "Concrete Trowel" (hereafter the "Neece Design Patent");
14. U.S. Pat. No. 4,766,634 issued to Louis DeVitis, R. D. on Aug. 30, 1988 for "Radius Edger" (hereafter the "634 DeVitis Patent");
15. U.S. Pat. No. 4,766,635 issued to Louis DeVitis, R. D. on Aug. 30, 1988 for "Interior Edge-Edger" (hereafter the "635 DeVitis Patent");
16. U.S. Design Pat. No. Des. 412,817 issued to Ronald Charland on Aug. 17, 1999 for "Fire Hose Section Hauler" (hereafter the "Charland Design Patent");

17. U.S. Pat. No. 6,415,472 issued to James T. Williams on Jul. 9, 2002 for "Circular Edging Tool For Concrete" (hereafter the "Williams Patent").

The Walter Patent discloses a cornice tool and shows a plasterer's molding plate which is handheld and which has various designs on the edge of the plate. This inventions was a handheld invention which was used for plastering.

The Benninghofen Patent discloses a trowel which creates a rounded bullet-nosed side. Further, referring to FIG. 4, the patent states "For different purposes the smoothing surfaces may be formed with a diversity of ribs and grooves, as desired, one modified form of construction being shown in FIG. 4, wherein the combination of a rib 20 with a flange 9 forms a semicircular groove 21 . . . . " Therefore, this patent discloses a single rounded shape formed into an edge of a cement pavement.

The Ferguson Patent discloses a trowel which relates to plastering tools and more particularly, to a trowel where a suitable design of plastic cornices or moldings may be readily and uniformly made on the walls and ceilings of a room.

The Johnson Patent discloses a trowel which is used for forming grooves or curved corners on cement floors as well as finishing walls and buildings. In this case, the design shows that the trowel has a rounded surface so that it can create a rounded form for a concave shape on the cement border or any other portion of the cement surface. This again has only one rounded design.

The Busch Patent discloses a trowel and also shows the concept of having a handle so that the trowel can be pulled or pushed. As illustrated in FIG. 3, it shows the concept of having a rounded end or bullet-nosed end on the concrete. It also shows in FIG. 4 having various shapes but they are all one rounded shape.

The Baker Patent is a patent discloses a mason's trowel which is handheld. It is relevant because it shows a multiplicity of different shapes, round and primarily squared, in FIGS. 3, 4, 5, 6 and 7. However, it discloses no way to properly align the trowel with an edge of the poured concrete and no way to properly form an aligned series of novel multi-rounded shapes. This is primarily more of a mason's tools for walls and related types of structures.

The Hitzman Patent discloses a mortar spreader for spreading a shape onto a block 1 as best illustrated in FIGS. 3 through 6. The shape of the mortar itself has two rounded ends which are designed to form rounded edges on the block as illustrated in FIG. 5. In this way this spreads mortar into a rounded shape but it does not discloses a multiplicity of rounded shapes.

The Sanford Patent discloses an edger which is a form of trowel to finish cement work, with the edge attached to a pole.

The Cinotti Patent discloses a concrete edger and finishing tool. The object of this invention is to create a concrete edger in which the relative positioning of the parts, particularly of the handle and the blade, may be readily changed. The device is used only for flattening the concrete where the orientation of the handle 57 can be modified at different angles.

The Rawley Patent discloses a handheld forming tool for finishing both curved and flat surfaces.

The Perry Patent is a hand tool for finishing corners and the like. As disclosed in FIG. 9, the tool has a rounded member for putting a single rounded shape on corners of a structural area.

The Cotugno Patent discloses a concrete slab surface finishing tool which is provided with a combination flat floor surface working area, a lip offset surface working area joined to the flat floor surface working area, a flat lip surface working area joined to lip offset working area, and an edge surface working area joined to the flat lip surface working area. The tool has the ability to form one rounded edge at the bottom.

The Neece Patent is a design patent which protects the design of a particular concrete trowel.

The '634 DeVitis Patent is a hand tool which has a portion for showing how to make a rounded edge but this is just one bullet-nosed edge on the concrete.

The '634 DeVitis Patent discloses a hand tool for forming the interior edge of a cementitious surface. Once again, this is shown for the rounding features 8 and 6 of the tool. However, this once again is just one rounded portion.

The Charland Patent discloses a design patent for a fire house section hauler which has a rounded member for hauling a fire hose.

Finally, the Williams Patent is a circular edging tool for concrete. This patent is designed to have a circular concrete edge so that it can form the interior circle of a manhole frame.

None of the prior art patents disclose an apparatus to efficiently and effectively form a multiplicity of various rounded shapes into an edge of poured concrete. There is a significant need for such an apparatus.

SUMMARY OF THE INVENTION

The present invention is a novel tool which enables a mason or concrete worker to form very beautiful decorative designs into the edge of poured concrete which is used for a driveway, walkway, border of a planter, or other concrete structure having at least a partially flat surface and at least one side edge where the decorative design is formed. Through use of the present invention, any one of a multiplicity of multi-arcuate designs are formed into at least one side edge or outside edge or inside edge of a poured concrete slab to thereby significant beautify a driveway, walkway, planter border, or any other poured concrete structure.

It has been discovered, according to the present invention, that if a trowel is formed with a traverse lip which is intended to abut a frame border of a poured concrete structure and thereafter the trowel has a multiplicity of unique arcuate forms therein which extend to a flat surface structure at the uppermost part of the trowel, and the trowel has a receiving member for receiving a pole or handle formed into a location where the multi-rounded forms are located, then the trowel can be used to form beautiful arcuate designs into an edge of the poured concrete structure by aligning the transverse tip with the border of the structure, pressing the arcuate designs into the poured wet concrete until the flat edge rests on the flat portion of the poured concrete and pulling or pushing the trowel into and through the poured concrete and discarding the concrete which rests above the trowel, thereby leaving the beautiful arcuate designs formed into the edge of the poured concrete structure.

It is therefore a primary object of the present invention to create a trowel which is formed with a traverse lip which is intended to abut a frame border of a poured concrete structure and thereafter the trowel has a multiplicity of unique arcuate forms therein which extend to a flat surface structure at the uppermost part of the trowel, and the trowel has a receiving member for receiving a pole or handle formed into a location where the multi-rounded forms are located, so that the trowel can be used to form beautiful arcuate designs into an edge of the poured concrete structure by aligning the transverse tip with the border of the structure, pressing the arcuate designs into the poured wet concrete until the flat edge rests on the flat portion of the poured concrete and pulling or pushing the trowel into and through the poured concrete and discarding the concrete which rests above the trowel, thereby leaving the beautiful arcuate designs formed into the edge of the poured concrete structure.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
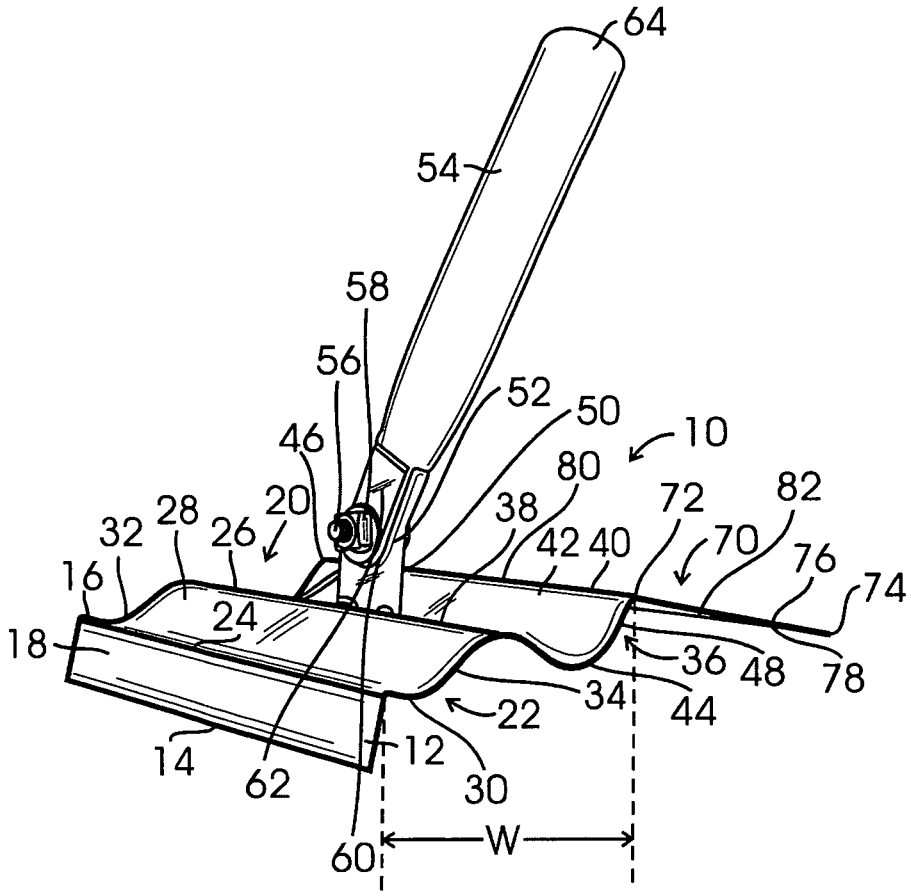
FIG. 1 is a perspective view of a pole operated trowel with multi-rounded designs in accordance with the present invention, illustrating a transverse tip extending into the multi-rounded design shaped portion which extends into an uppermost flat surface portion, a pole receiving member attached at a location on the upper surface of the multi-rounded design portion.

Referring to FIG. 1, there is illustrated a first embodiment of a pole operated trowel 10 of the present invention. The pole operated trowel 10 has a traverse side edge or lip 12 which has a bottom edge 14, a top edge 16 and an outward transverse surface 18. The top edge 16 of the lip 12 extends into the first arcuate surface section 22 of the multi-rounded design shaped portion 20 which has a first arcuate surface section 22 having a first edge 24, a second edge 26, a top rounded surface 28, a bottom rounded surface 30, a first side edge 32 and a second side edge 34; and a second arcuate surface section 36 which has a first edge 38, a second edge 40, a top rounded surface 42, a bottom rounded surface 44, a first side edge 46 and a second side edge 48. The top edge 16 of lip 12 extends into the first edge 24 of first arcuate surface section 22 and the second edge 26 of first arcuate surface section 22 extends into the first edge 38 of second arcuate surface section 36. Attached at a location on the upper surface of the multi-rounded design shaped portion 20 is an attachment means 50 which is rotatably connected to a pole receiving means 54. By way of example only, the attachment means 50 can be a transverse plate which is attached at a location adjacent the intersection of first arcuate surface section 22 and the second arcuate surface section 36. By way of example only, the pole receiving means 54 is attached to the transverse plate 50 by having an opening 52 in the transverse plate 50 and a threaded bolt 56 extending through an opening 60 in a collar 62 at the lower end of the pole receiving means 54 which is aligned with the opening 52 in the transverse plate and the nut 58 threaded onto the threaded bolt 56. The pole receiving means has an opening 64 to receive a pole. The second edge 40 of the second arcuate surface section 36 extends into the first edge 72 of an uppermost flat plate section 70 which also has a second or leading edge 74, a top surface 76, a bottom surface 78, a first side edge 80 and a second side edge 82.

The pole operated trowel 10 is shown in operation in FIGS. 3 through 6 to create beautiful decorative side edges on a poured concrete driveway 200. By way of example, there is illustrated a street 500, a driveway area 510, and a garage door 520 at the end of the driveway area 510 remote from the street 500. A border is formed around the concrete driveway area 510 which comprises a multiplicity of border members which are usually 2×4 pieces of lumber. A multiplicity of 2×4 lumber members 530 are positioned along a first side edge 512 of the driveway area 510 and rest between the side edge 512 a portion of lawn 542. A multiplicity of 2×4 lumber members 532 are positioned along an opposite second side edge 514 of the driveway area 510 and rest between the side edge 514 a portion of lawn 544. A multiplicity of 2×4 lumber members 534 are positioned along a first transverse edge 516 of the driveway area 510 and rest between the first transverse edge 516 and the floor beneath the garage door 520. A multiplicity of 2×4 lumber members 536 are positioned along an opposite second transverse edge 518 of the driveway area 510 and rest between the second transverse edge 516 and the street 500. Therefore, the lumber members 530, 532, 534 and 536 having respective interior sides 531, 533, 535 and 537 form a rectangular border round the driveway area 510 where the concrete is to be poured to form the driveway. The border members are formed to be the same height as the top surface 552 of the concrete 550. The concrete 550 is poured in the traditional manner. Typically, a cross-grid of metal such as wire rods rest on the ground over which the concrete is to be poured. The concrete 550 is poured into the driveway area 510 within the area surrounded by 2×4 lumber members 530, 532, 534 and 536. The mason 600 typically pushes and or pulls on a flattening tool which can be another 2×4 in order to provide a flat smooth upper surface 552 to the poured concrete 550.

Figure 5:
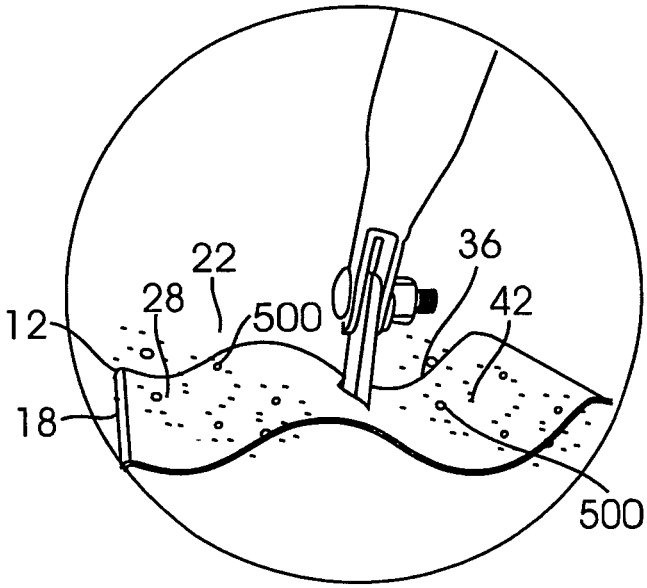
FIG. 5 is an enlarged perspective view illustrating concrete resting on top of the multi-rounded arcuate shaped portion of the trowel.
Figure 6:
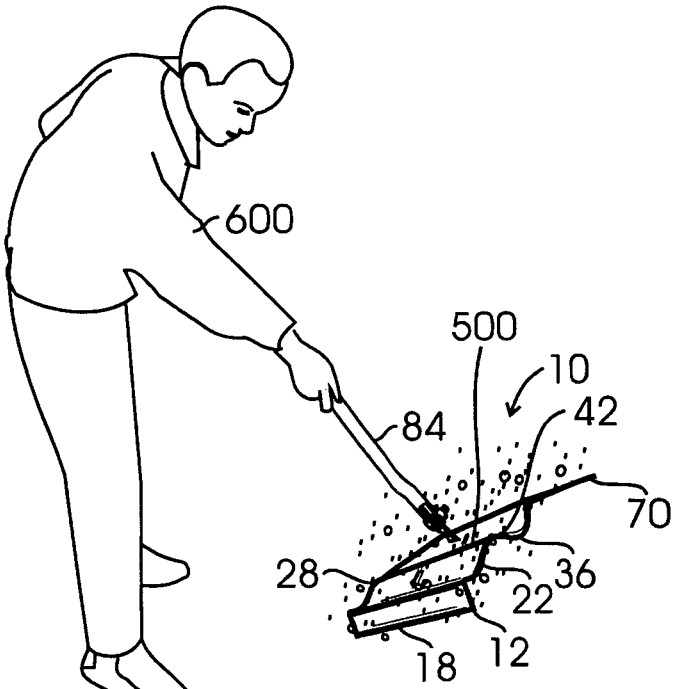
FIG. 6 is an enlarged perspective view illustrating the concrete being discarded from the top of the multi-rounded arcuate shaped portion of the trowel.

The present invention pole operated trowel 10 is used after the concrete 550 has been poured and the upper surface 552 smoothed and flattened and while the concrete 550 is still wet. The mason 600 stands (or can kneel) to one side of the driveway area 510 and can stand on the lawn 542 or on a portion of the lumber members 530. The mason 600 aligns the pole operated trowel 10 such that its transverse side edge 12 is adjacent the interior edge 531 of the 2×4 lumber members 530 and the mason pushes the pole operated trowel 10 into the concrete 550 so that outward transverse surface 18 rests against the interior surface 531 of lumber members 532. The pole operated trowel 10 is pushed into the wet concrete 550 until the bottom surface 78 of flat plate such 70 rests on the top surface 552 of the poured concrete 550. From the perspective view illustrated in FIG. 1, it is now apparent that the first arcuate surface section 22 and second arcuate surface section 36 of the multi-rounded design shaped portion 20 are pushed into the wet concrete 550 and rest below the upper surface 552 of the concrete in the area bounded by the interior edge 531 of the 2×4 lumber members 530 and the width "W" of the multi-rounded portion 20 extending from first edge 24 to second edge 40. A pole 84 is retained within the opening 64 of pole receiving means 54 and the mason pulls the pole operated trowel 10 through the wet concrete 550. After every few inches, the desired multi-rounded shape is formed into the wet concrete in the area below the first and second arcuate surface sections 22 and 36 of the multi-rounded design shaped portion 20. The concrete on the respective top surfaces 28 ad 42 of the arcuate surface sections 22 and 36 piles up as shown in FIG. 5 and is thrown away as illustrated in FIG. 6. The discarded concrete is thrown into a trash receiving container (not shown).

Figure 7:
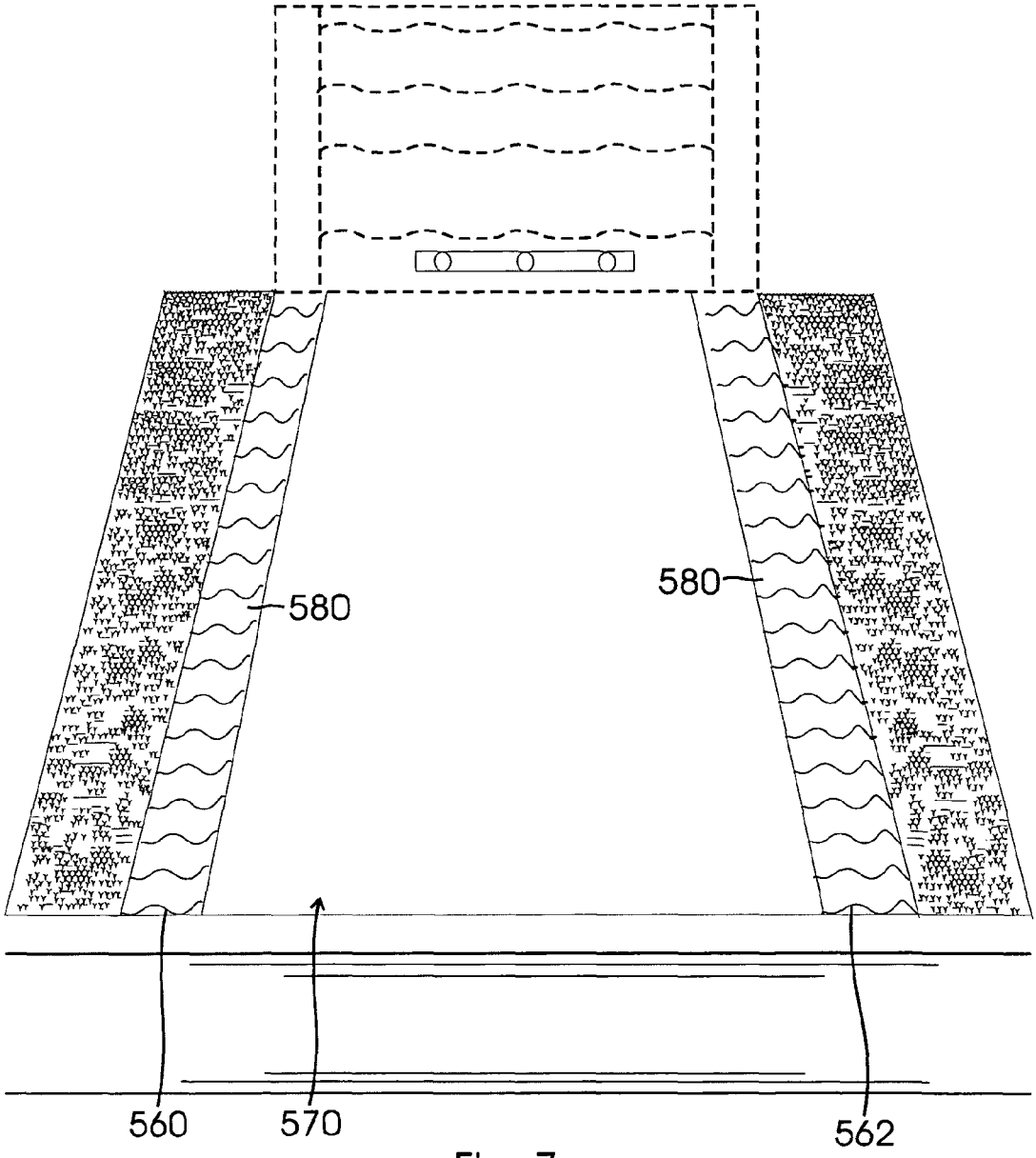
FIG. 7 is a perspective view of the completed driveway with the beautiful multi-rounded arcuate designs formed into both side edges of the driveway illustrated in FIGS. 3 and 4.

The mason pulls the pole operated trowel 10 through the wet concrete 550 in this manner from the first transverse edge 516 adjacent the garage door 520 to the second transverse edge 518 adjacent the street 500. The pole operated trowel 10 can also be pushed in the opposite direction to smooth over the arcuate design left underneath the pole operated trowel 10. The collar 62 and threaded bolt 56 permit the angle of the pole 84 relative to the mason 600 to be adjusted to any angle so that the pulling angle of the design formed into the wet concrete can be of any height and longitudinal angle relative to the ground. The key innovation of the present invention over prior art trowels is that the present invention enables the mason to create any number of variations of arcuate designs into the edge 560 of the driveway 570 as illustrated in FIG. 7 so that an infinite number of multi-rounded designs of substantial aesthetic beauty can be formed into the side edge 560 of the driveway 570.

After one edge 560 is completed, the opposite edge of the driveway is embellished in the same manner while the concrete is still wet. The mason now stands (or can kneel) to the opposite side of the driveway area 510 and can stand on the lawn 544 or on a portion of the lumber members 532. The mason 600 aligns the pole operated trowel 10 such that its transverse side edge 12 is adjacent the interior edge 533 of the 2×4 lumber members 532 and pushes the pole operated trowel 10 into the concrete 550 so that outward transverse surface 18 rests against the interior surface 533 of lumber members 532. The pole operated trowel 10 is pushed into the wet concrete 550 until the bottom surface 78 of flat plate such 70 rests on the top surface 552 of the poured concrete. From the perspective view illustrated in FIG. 1, it is now apparent that the first arcuate surface section 22 and second arcuate surface section 36 of the multi-rounded design shaped portion 20 are pushed into the wet concrete 550 and rest below the upper surface 552 of the concrete in the area bounded by the interior edge 533 of the 2×4 lumber members 532 and the width "W" of the multi-rounded portion 20 extending from first edge 24 to second edge 40. A pole 84 is retained within the opening 64 of pole receiving means 54 and the mason pulls the pole operated trowel 10 through the wet concrete 550. After every few inches, the desired multi-rounded shape is formed into the wet concrete in the area below the first and second arcuate surface sections 22 and 36 of the multi-rounded design shaped portion 20. The concrete on the respective top surfaces 28 ad 42 of the arcuate surface sections 22 and 36 piles up as shown in FIG. 5 and is thrown away as illustrated in FIG. 6. The discarded concrete is thrown into a trash receiving container (not shown).

The mason pulls the pole operated trowel 10 through the wet concrete 550 in this manner from the first transverse edge 516 adjacent the garage door 520 to the second transverse edge 518 adjacent the street 500 or in the opposite direction from the street 500 to the location adjacent the garage door 520. The pole operated trowel 10 can also be pushed in the opposite direction to smooth over the arcuate design left underneath the pole operated trowel 10. The collar 62 and threaded bolt 56 permit the angle of the pole 84 relative to the mason 600 to be adjusted to any angle so that the pulling angle of the design formed into the wet concrete can be of any height and longitudinal angle relative to the ground.

The key innovation of the present invention over prior art trowels is that the present invention enables the mason to create any number of variations of arcuate designs into the opposite edge of the driveway 562 so that an infinite number of multi-rounded designs 580 of substantial aesthetic beauty can be formed into the side edge of the driveway 562. The competed designed 580 on both side edges 560 and 562 of the driveway 570 is illustrated in FIG. 7.

Figure 2:
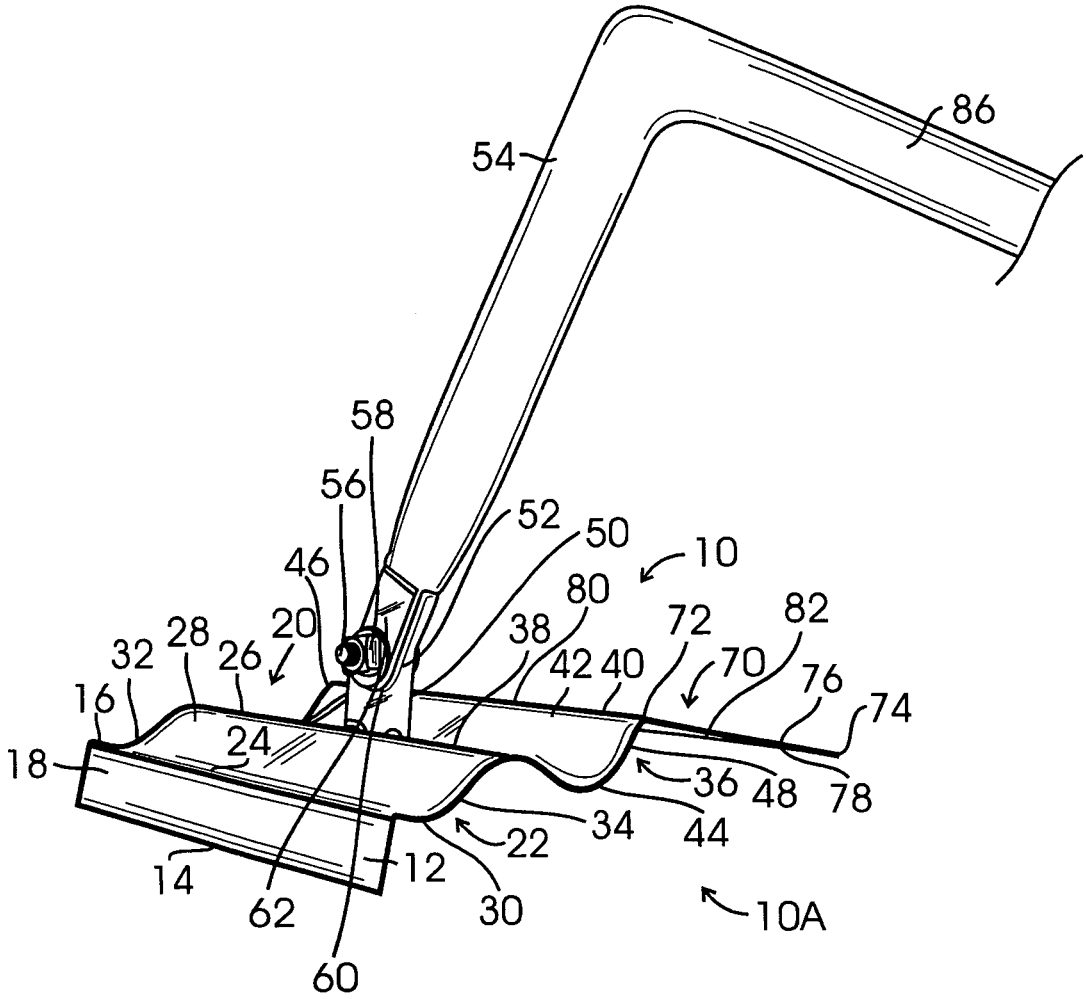
FIG. 2 is a perspective view of a handheld trowel with multi-rounded designs in accordance with the present invention, illustrating a transverse tip extending into the multi-rounded design shaped portion which extends into an uppermost flat surface portion, a handle attached at a location on the upper surface of the multi-rounded design portion.
Figure 3:
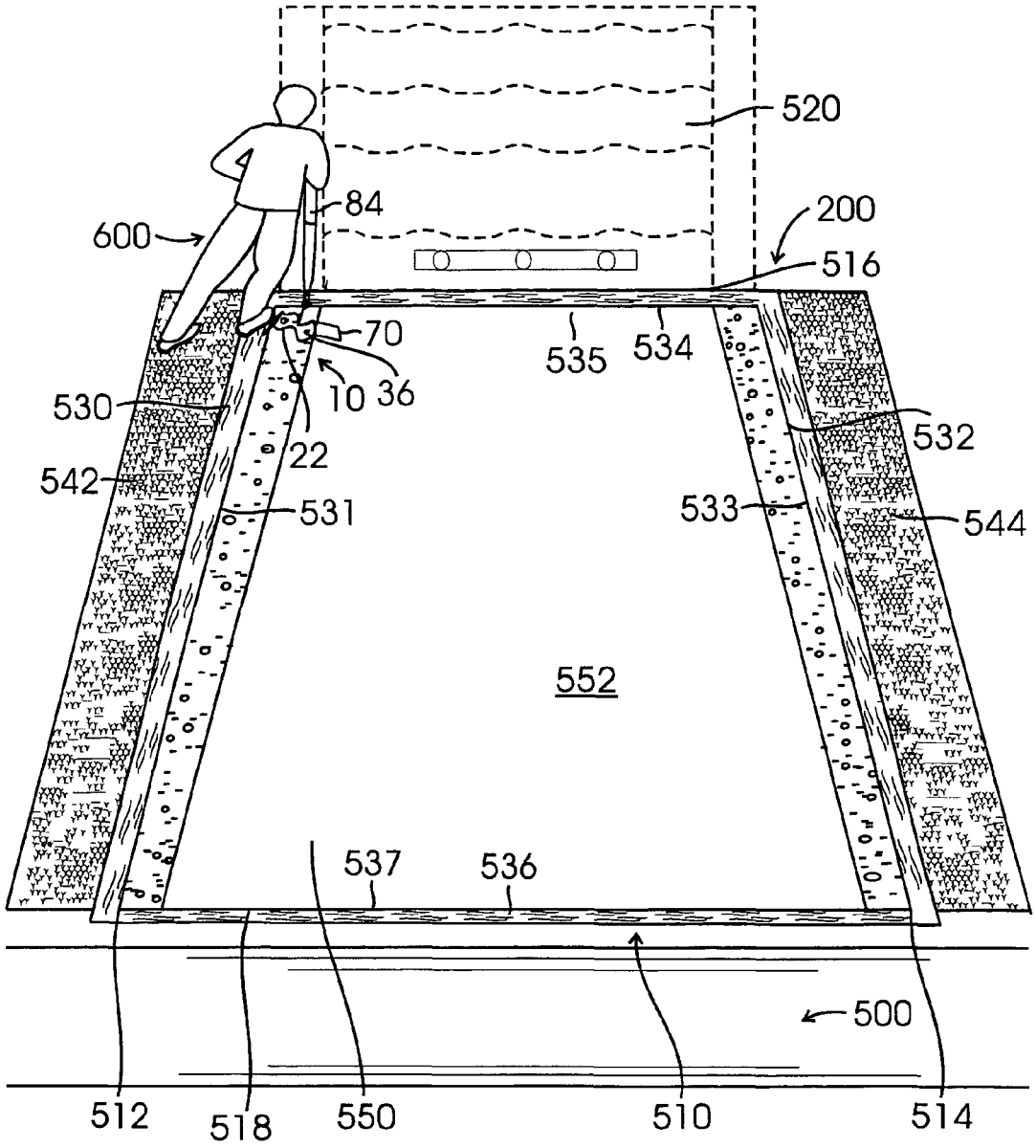
FIG. 3 is a perspective view of the present invention in operation where the trowel illustrated in FIG. 1 is used to form a very decorative multi-rounded edge into one side of a poured concrete driveway.
Figure 4:
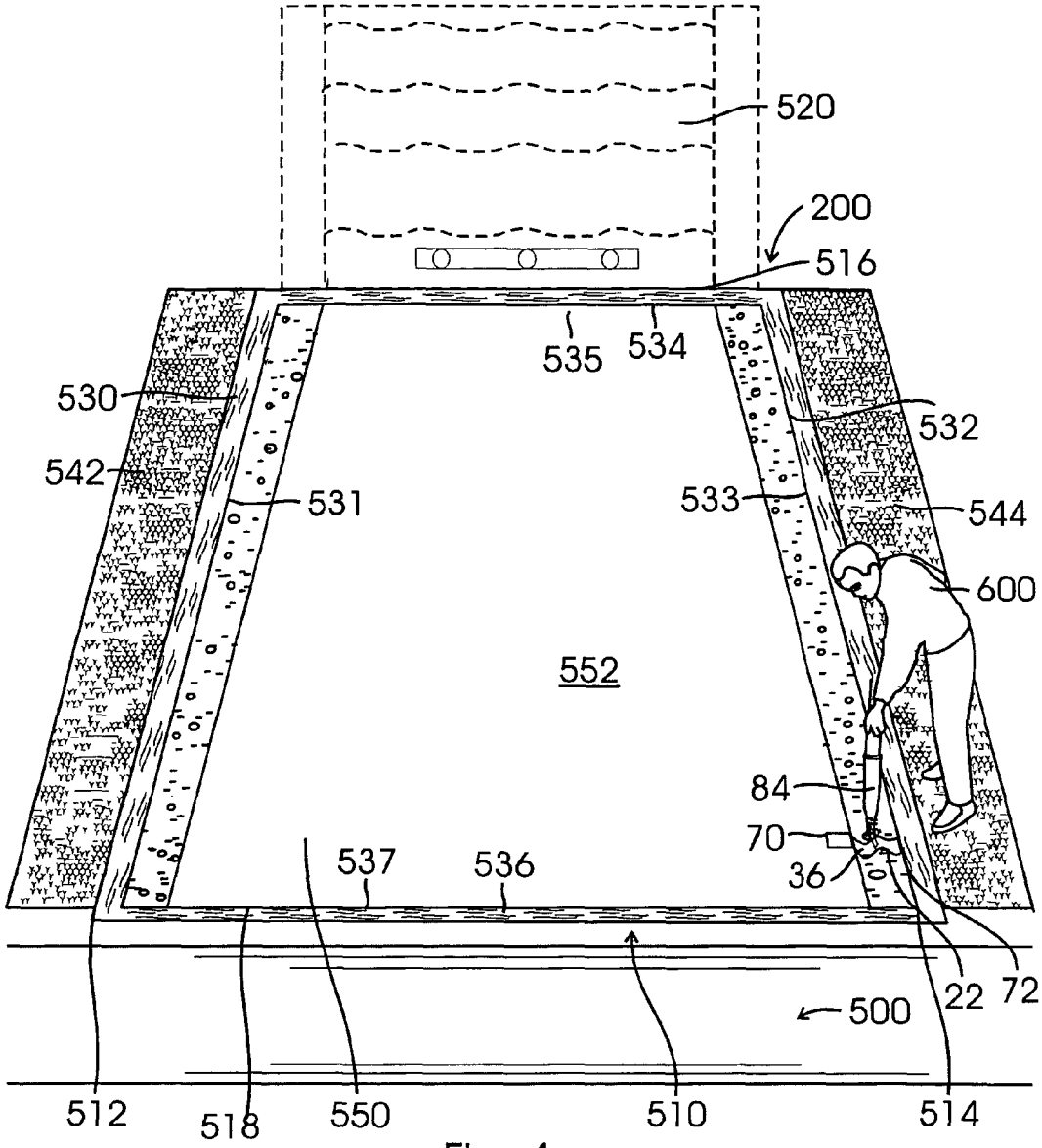
FIG. 4 is a perspective view of the present invention in operation where the trowel illustrated in FIG. 1 is used to form a very decorative multi-rounded edge into the opposite side of the poured concrete driveway illustrated in FIG. 3.

The preferred embodiment of the present invention is to have the pole 84 as this provides the most leverage to enable the mason 600 to pull or push the trowel 10 through the heavy concrete and lift the concrete laden trowel 10 to discard the concrete which rests above the trowel as it is pulled through the driveway. In an alternative embodiment illustrated in FIG. 2, the trowel 10A can be a hand operated trowel. The parts are identical to the parts in the pole operated trowel illustrated in FIG. 1 and are numbered the same, but instead of receiving a pole 84, the opening 64 receives a handle member 86. It is also within the spirit and scope of the present invention for the handle member to be of any shape and with the handle 86 rotatably mounted onto the body of the 10A as illustrated in FIG. 2 or mounted in a fixed orientation. The pulling and pushing operation using the handle operated trowel 10A is similar to the operation illustrated in FIGS. 3 through 6 but instead the mason 600 kneels on the lawn 542 or 544 and/or on the 2×4 members 530 and 532. This is a more difficult operation because the mason 600 does not have the leverage to pull and push the heavy concrete and throw it away as the mason 600 has when the mason 600 is standing. Therefore, while the hand operated trowel 10A is also within the spirit and scope of the present invention, the pole operated trowel 10 is the preferred embodiment for creating designs into a heavy concrete driveway or other heavy concrete surface.

While the present invention has been illustrated to create a multiplicity of beautiful arcuate designs into a concrete driveway, it will be appreciated that it can be used to create beautiful a multi-arcuate design in a the border of a flowerbed or other concrete structure on the ground. The same principles apply. The structure is surrounded with a wooden border or border made of other suitable material which will not adhere to concrete and the outward transverse surface 18 of the transverse side edge or lip 12 rests against the interior surface border (the interior surface of the border is defined as the surface of the border facing the concrete) while the bottom surface 78 of flat plate section 70 rests on the upper interior level of the structure and the sections of the multi-rounded design shaped portion 20 are pushed into the edge of the concrete structure and pulled and pushed through it as was described above to create the beautiful multi-rounded arcuate design shape into the border of the concrete structure.

Figure 8:
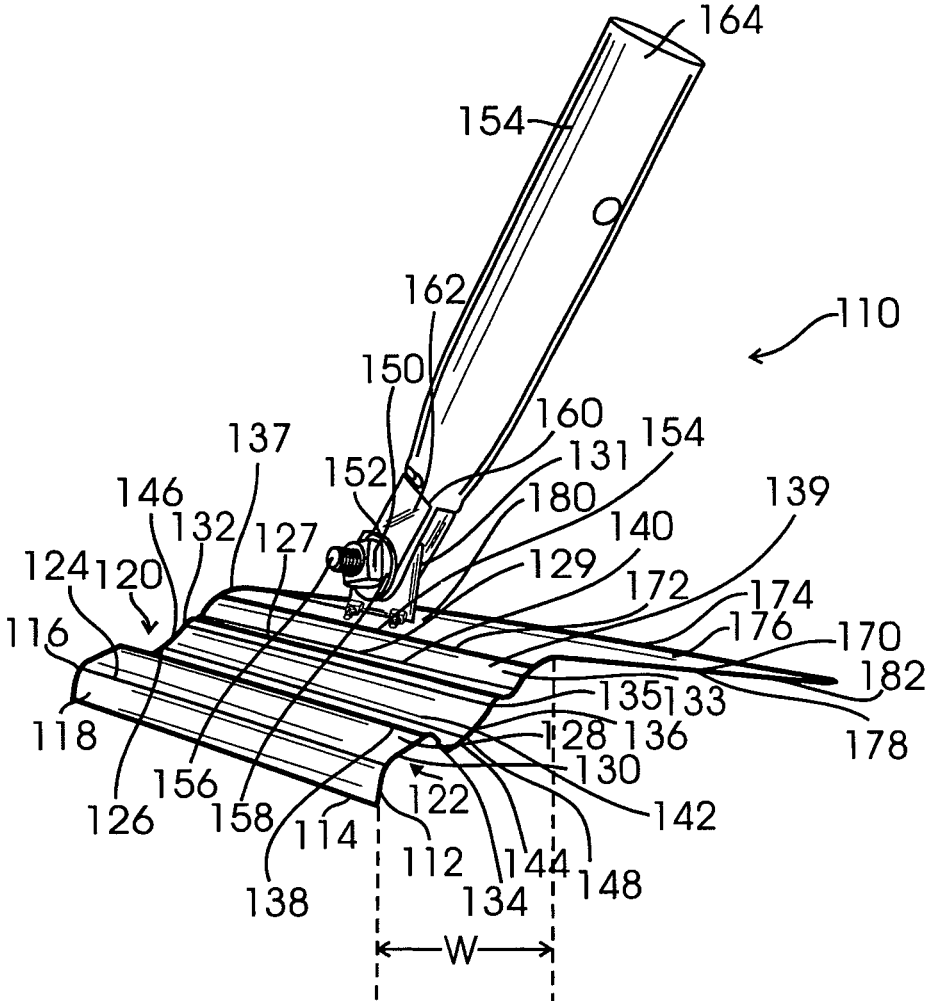
FIG. 8 is a perspective view of an alternative embodiment of a pole operated trowel with alternative multi-rounded designs in accordance with the present invention, illustrating a transverse tip extending into the alternative multi-rounded design shaped portion which extends into an uppermost flat surface portion, a pole receiving member attached at a location on the upper surface of the alternative multi-rounded design shaped portion.

It will be appreciated that the multi-rounded design illustrated in FIGS. 1 through 7 is only one of numerous multi-rounded designs that are within the spirit and scope of the present invention. Referring to FIG. 8, there is illustrated one of the numerous alternative multi-rounded designs that are within the spirit and scope of the present invention. In this alternative variation, instead of having two arcuate surface sections, there are three arcuate surface sections. It will be appreciated that it is within the spirit and scope of the present invention to have any number and shape of arcuate surface sections.

Referring to FIG. 8, there is illustrated an alternative embodiment of a pole operated trowel 110 of the present invention. The pole operated trowel 110 has a traverse side edge or lip 112 which has a bottom edge 114, a top edge 116 and an outward transverse surface 118. The top edge 116 of the lip 112 extends into the first arcuate surface section 122 of the multi-rounded design shaped portion 120 which has a first arcuate surface section 122 having a first edge 124, a second edge 126, a top rounded surface 128, a bottom rounded surface 130, a first side edge 132 and a second side edge 134; a second arcuate surface section 136 which has a first edge 138, a second edge 140, a top rounded surface 142, a bottom rounded surface 144, a first side edge 146 and a second side edge 148; and in this variation a third arcuate surface section 127 which has a first edge 129, a second edge 131, a top rounded surface 133, a bottom rounded surface 135, a first side edge 137 and a second side edge 139. The top edge 116 of lip 112 extends into the first edge 124 of first arcuate surface section 122, the second edge 126 of first arcuate surface section 122 extends into the first edge 138 of second arcuate surface section 136, and the second edge 140 of the second arcuate surface section 136 extends into the first edge 129 of third arcuate surface section 127. The second edge 131 of the third arcuate surface section 127 extends into the first edge 172 of an uppermost flat plate section 170 which also has a second or leading edge 174, a top surface 176, a bottom surface 178, a first side edge 180 and a second side edge 182.

In this variation of the pole operate trowel 110, attached at a location on the top surface 176 of the uppermost flat plate section 170 is an attachment means 150 which is rotatably connected to a pole receiving means 154. By of example only, the attachment means 150 can be a transverse plate which is attached at a location on the top surface 176 of the uppermost flat plate section 170. It will be appreciated that the attachment means can be on any upper surface of the pole operated trowel 110. By way of example only, the pole receiving means 154 is attached to the transverse plate 150 by having an opening 152 in the transverse plate 150 and a threaded bolt 156 extending through an opening 160 in a collar 162 at the lower end of the pole receiving means 154 which is aligned with the opening 152 in the transverse plate and the nut 158 threaded onto the threaded bolt 156. The pole receiving means has an opening 164 to receive a pole.

The pole operated trowel 110 is shown in operation in FIGS. 9 through 12 to create beautiful decorative side edges on a poured concrete driveway 400. By way of example, there is illustrated a street 605, a driveway area 610, and a garage door 620 at the end of the driveway area 610 remote from the street 605. A border is formed around the concrete driveway area 610 which comprises a multiplicity of border members which are usually 2×4 pieces of lumber. A multiplicity of 2×4 lumber members 630 are positioned along a first side edge 612 of the driveway area 610 and rest between the side edge 612 a portion of lawn 642. A multiplicity of 2×4 lumber members 632 are positioned along an opposite second side edge 614 of the driveway area 610 and rest between the side edge 614 a portion of lawn 644. A multiplicity of 2×4 lumber members 634 are positioned along a first transverse edge 616 of the driveway area 610 and rest between the first transverse edge 616 and the floor beneath the garage door 620. A multiplicity of 2×4 lumber members 636 are positioned along an opposite second transverse edge 618 of the driveway area 610 and rest between the second transverse edge 618 and the street 605. Therefore, the lumber members 630, 632, 634 and 636 Having respective interior sides 631, 633, 635 and 637 form a rectangular border round the driveway area 610 where the concrete is to be poured to form the driveway. The border members are formed to be the same height as the top surface 652 of the concrete 650. The concrete 650 is poured in the traditional manner. Typically, a cross-grid of metal such as wire rods rest on the ground over which the concrete is to be poured. The concrete 650 is poured into the driveway area 610 within the area surrounded by 2×4 lumber members 630, 632, 634 and 636. The mason 600 typically pushes and or pulls on a flattening tool which can be another 2×4 in order to provide a flat smooth upper surface 552 to the poured concrete 650.

Figure 12:
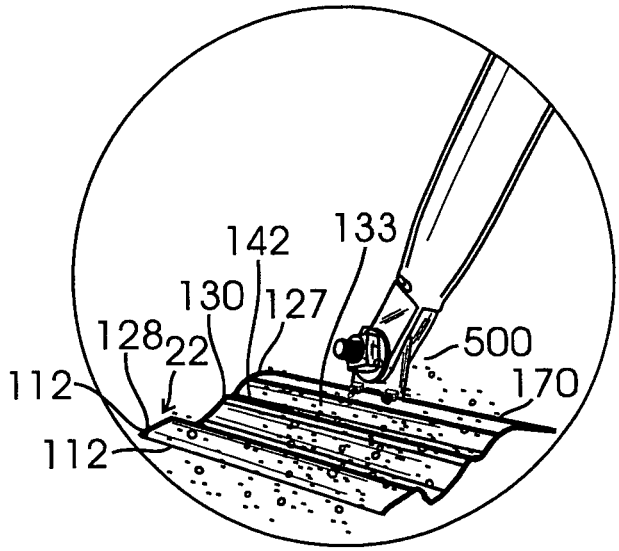
FIG. 12 is an enlarged perspective view illustrating concrete resting on top of the alternative embodiment of the multi-rounded arcuate shaped portion of the trowel.
Figure 13:
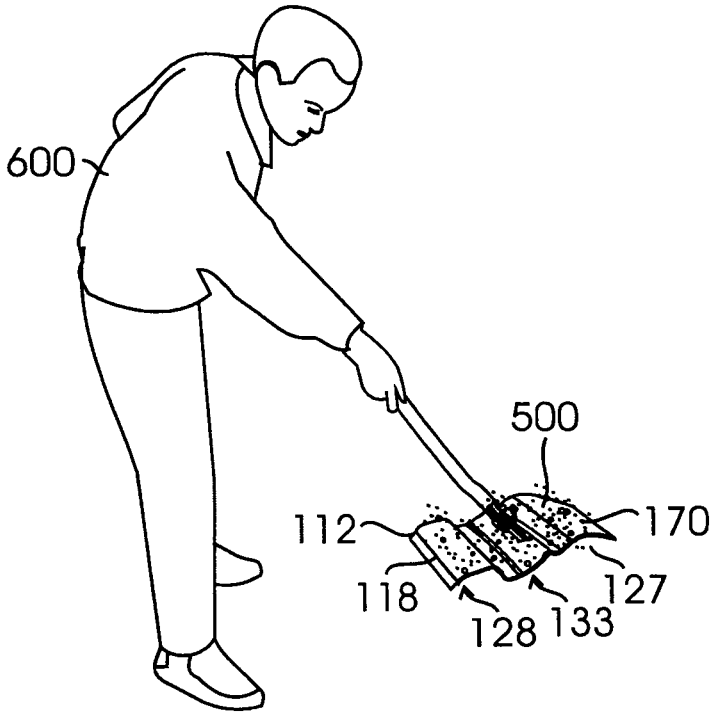
FIG. 13 is an enlarged perspective view illustrating the concrete being discarded from the top of the alternative embodiment of the multi-rounded arcuate shaped portion of the trowel.

The present invention pole operated trowel 110 is used after the concrete 650 has been poured and the upper surface 652 smoothed and flattened and while the concrete 650 is still wet. The mason 600 stands (or can kneel) to one side of the driveway area 610 and can stand on the lawn 642 or on a portion of the lumber members 630. The mason 600 aligns the pole operated trowel 110 such that its transverse side edge 112 is adjacent the interior edge 631 of the 2×4 lumber members 630 and pushes the pole operated trowel 110 into the concrete 650 so that outward transverse surface 118 rests against the interior surface 631 of lumber members 632. The pole operated trowel 110 is pushed into the wet concrete 650 until the bottom surface 178 of flat plate section 170 rests on the top surface 652 of the poured concrete 650. From the perspective view illustrated in FIG. 7, it is now apparent that the first arcuate surface section 122, the second arcuate surface section 136, and the third arcuate surface section 127 of the multi-rounded design shaped portion 120 are pushed into the wet concrete 650 and rest below the upper surface 652 of the concrete in the area bounded by the interior edge 631 of the 2×4 lumber members 630 and the width "W'" of the multi-rounded portion 120 extending from first edge 124 to second edge 131. A pole 184 is retained within the opening 164 of pole receiving means 154 and the mason pulls the pole operated trowel 110 through the wet concrete 650. After every few inches, the desired multi-rounded shape is formed into the wet concrete in the area below the first, second and third arcuate surface sections 122, 136 and 127 of the multi-rounded design shaped portion 120. The concrete on the respective top surfaces 128, 142 and 133 of the arcuate surface sections 122, 136 and 127 piles up as shown in FIG. 12 and is thrown away as illustrated in FIG. 13. The discarded concrete is thrown into a trash receiving container (not shown).

Figure 14:
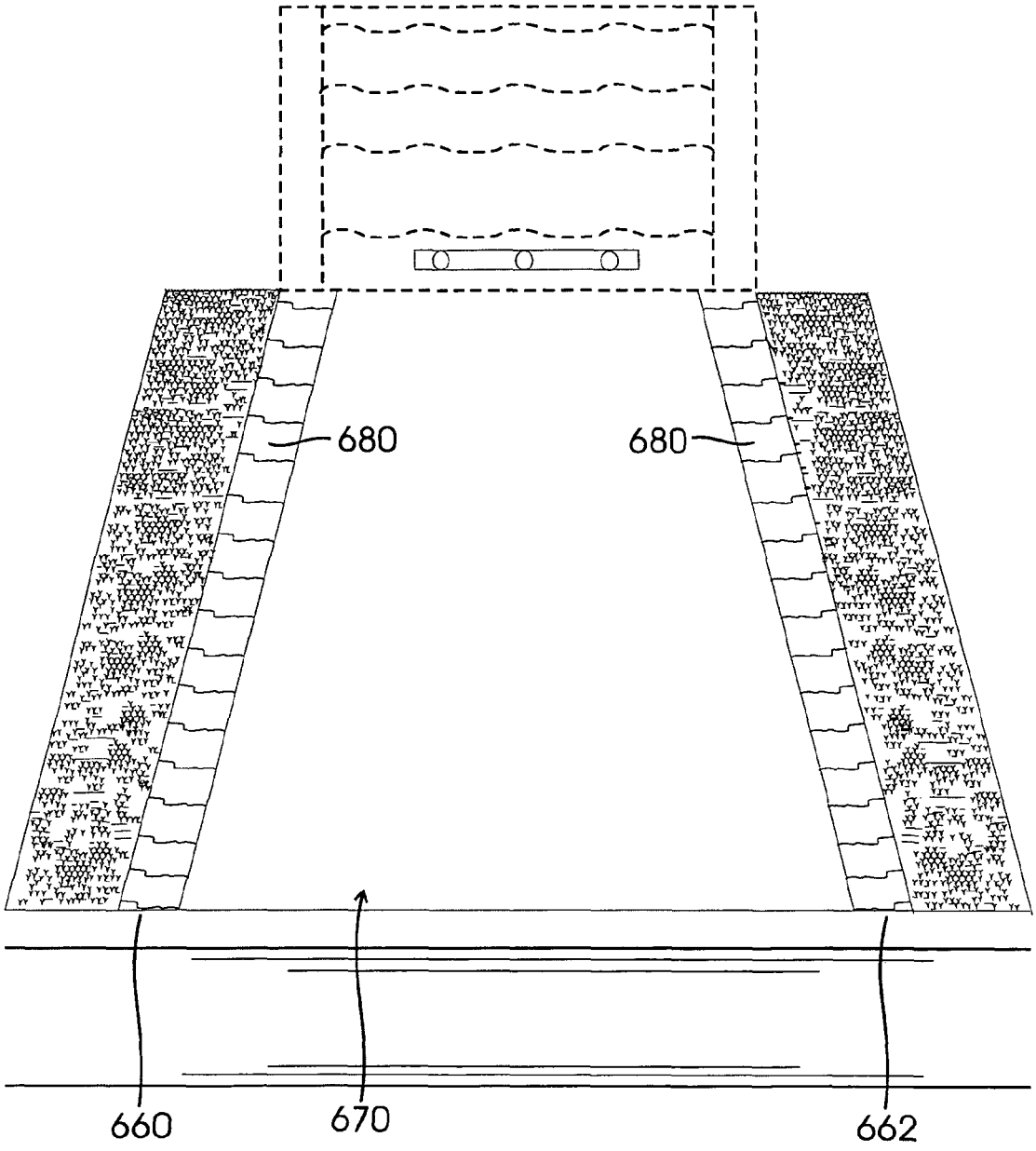
FIG. 14 is a perspective view of the completed driveway with the beautiful alternative embodiment multi-rounded arcuate designs formed into both side edges of the driveway illustrated in FIGS. 10 and 11.

The mason pulls the pole operated trowel 110 through the wet concrete 650 in this manner from the first transverse edge 616 adjacent the garage door 620 to the second transverse edge 618 adjacent the street 605. The pole operated trowel 110 can also be pushed in the opposite direction to smooth over the arcuate design left underneath the pole operated trowel 110. The collar 162 and threaded bolt 156 permit the angle of the pole 184 relative to the mason 600 to be adjusted to any angle so that the pulling angle of the design formed into the wet concrete can be of any height and longitudinal angle relative to the ground. The key innovation of the present invention over prior art trowels is that the present invention enables the mason to create any number of variations of arcuate designs into the edge 660 of the driveway 670 as illustrated in FIG. 14 so that an infinite number of multi-rounded designs of substantial aesthetic beauty can be formed into the side edge 660 of the driveway 670.

After one edge 660 is completed, the opposite edge of the driveway is embellished in the same manner while the concrete is still wet. The mason now stands (or can kneel) to the opposite side of the driveway area 610 and can stand on the lawn 644 or on a portion of the lumber members 632. The mason 600 aligns the pole operated trowel 110 such that its transverse side edge 112 is adjacent the interior edge 633 of the 2×4 lumber members 632 and pushes the pole operated trowel 110 into the concrete 650 so that outward transverse surface 118 rests against the interior surface 633 of lumber members 632. The pole operated trowel 110 is pushed into the wet concrete 650 until the bottom surface 178 of flat plate section 170 rests on the top surface 652 of the poured concrete. From the perspective view illustrated in FIG. 8, it is now apparent that the first arcuate surface section 122, the second arcuate surface section 136 and third arcuate surface section 127 of the multi-rounded design shaped portion 210 are pushed into the wet concrete 650 and rest below the upper surface 652 of the concrete in the area bounded by the interior edge 633 of the 2×4 lumber members 632 and the width "W'" of the multi-rounded portion 120 extending from first edge 124 to second edge 131. A pole 184 is retained within the opening 164 of pole receiving means 154 and the mason pulls the pole operated trowel 110 through the wet concrete 650. After every few inches, the desired multi-rounded shape is formed into the wet concrete in the area below the first, second and third arcuate surface sections 122, 136 and 127 of the multi-rounded design shaped portion 120. The concrete on the respective top surfaces 128, 142 and 133 of the arcuate surface sections 122, 136 and 127 piles up as shown in FIG. 12 and is thrown away as illustrated in FIG. 13. The discarded concrete is thrown into a trash receiving container (not shown).

The mason pulls the pole operated trowel 110 through the wet concrete 650 in this manner from the first transverse edge 616 adjacent the garage door 620 to the second transverse edge 618 adjacent the street 605 or in the opposite direction from the street 605 to the location adjacent the garage door 620. The pole operated trowel 110 can also be pushed in the opposite direction to smooth over the arcuate design left underneath the pole operated trowel 110. The collar 162 and threaded bolt 156 permit the angle of the pole 184 relative to the mason 600 to be adjusted to any angle so that the pulling angle of the design formed into the wet concrete can be of any height and longitudinal angle relative to the ground.

The key innovation of the present invention over prior art trowels is that the present invention enables the mason to create any number of variations of arcuate designs into the opposite edge of the driveway 662 so that an infinite number of multi-rounded designs 680 of substantial aesthetic beauty can be formed into the side edge of the driveway 662. The competed designed 680 on both side edges 660 and 662 of the driveway 670 is illustrated in FIG. 14.

Figure 9:
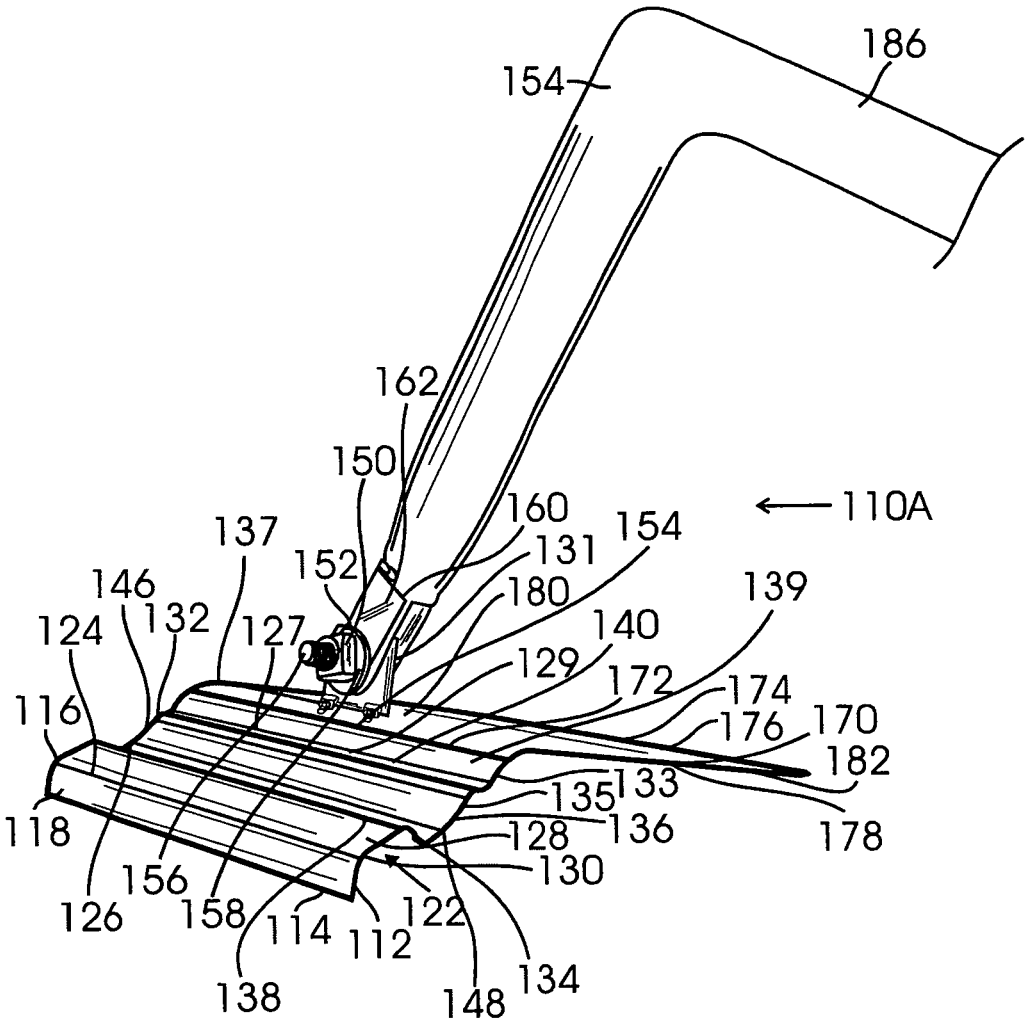
FIG. 9 is a perspective view of an alternative handheld trowel with alternative multi-rounded designs in accordance with the present invention, illustrating a transverse tip extending into the alternative multi-rounded design shaped portion which extends into an uppermost flat surface portion, a handle attached at a location on the upper surface of the alternative multi-rounded design shaped portion.
Figure 10:
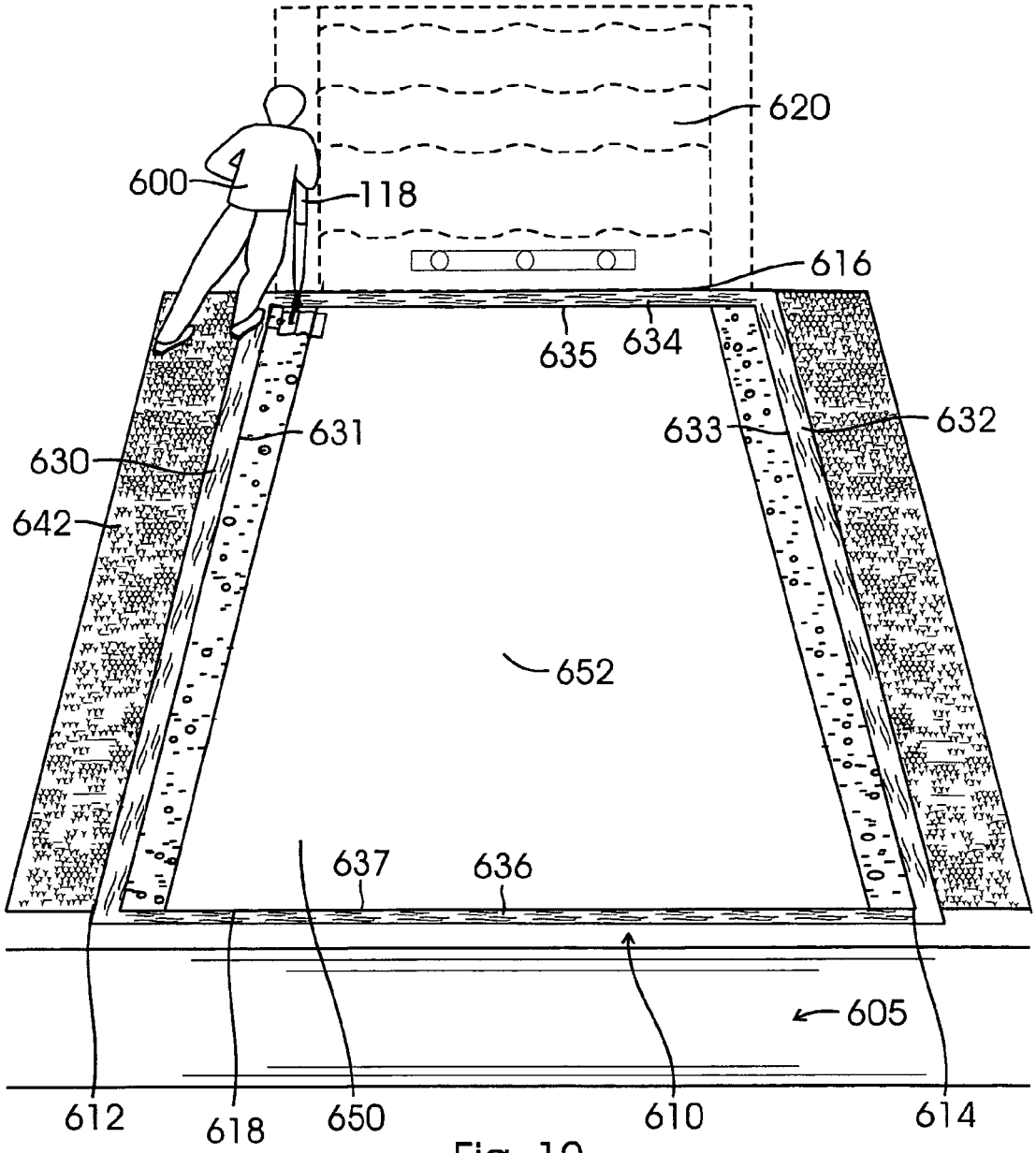
FIG. 10 is a perspective view of the alternative embodiment of the present invention in operation where the trowel illustrated in FIG. 8 is used to form an alternative very decorative multi-rounded edge into one side of a poured concrete driveway.
Figure 11:
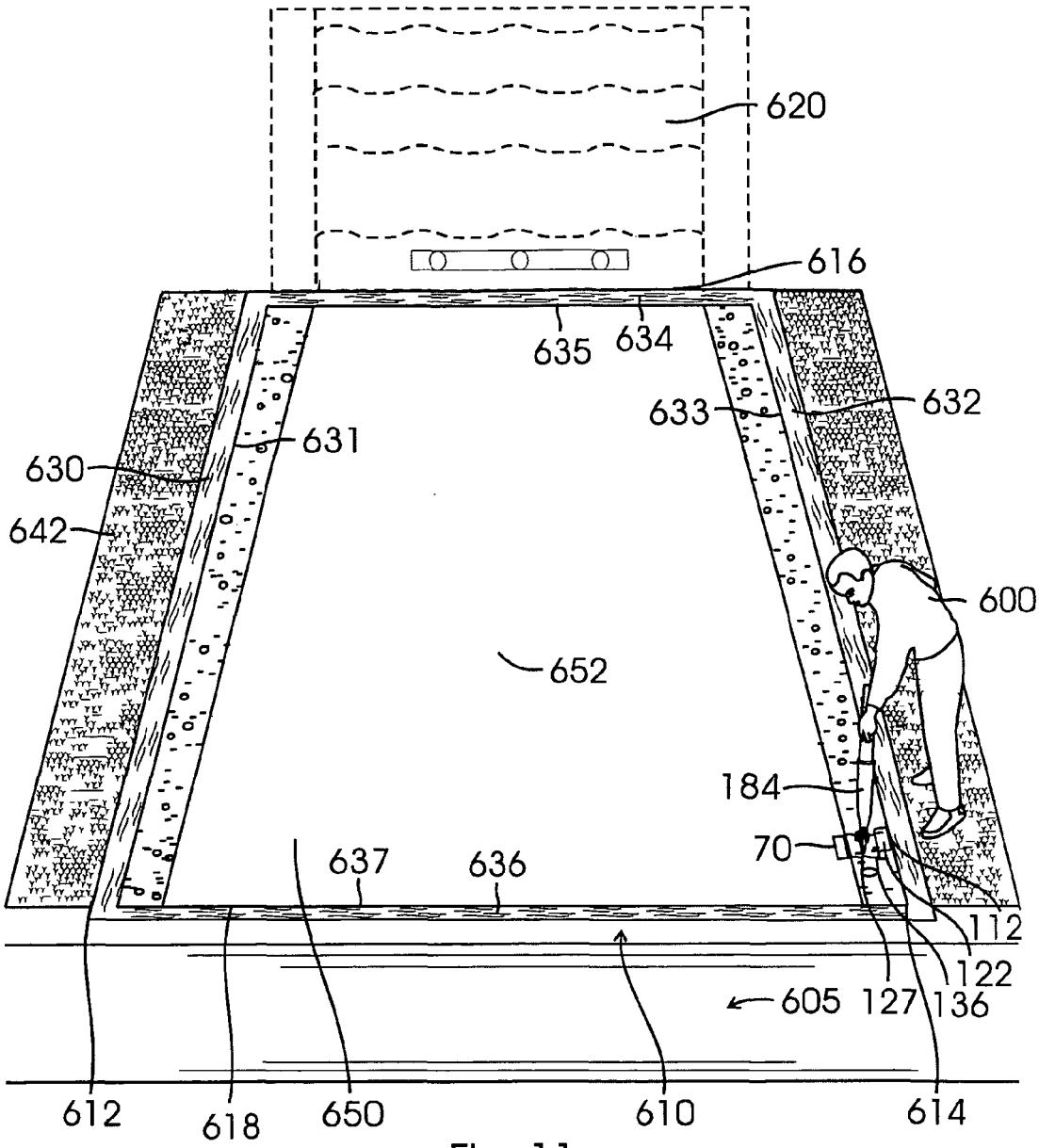
FIG. 11 is a perspective view of the alternative embodiment of the present invention in operation where the trowel illustrated in FIG. 8 is used to form an alternative very decorative multi-rounded edge into the opposite side of the poured concrete driveway illustrated in FIG. 10.

The preferred embodiment of the present invention is to have the pole 184 as this provides the most leverage to enable the mason 600 to pull or push the trowel 110 through the heavy concrete and lift the concrete laden trowel 110 to discard the concrete which rests above the trowel as it is pulled through the driveway. In an alternative embodiment illustrated in FIG. 9, the trowel 110A can be a hand operated trowel. The parts are identical to the parts in the pole operated trowel illustrated in FIG. 8 and are numbered the same, but instead of receiving a pole 184, the opening 164 receives a handle member 186. It is also within the spirit and scope of the present invention for the handle member to be of any shape and with the handle 186 rotatably mounted onto the body of the 110A as illustrated in FIG. 9 or mounted in a fixed orientation. The pulling and pushing operation using the handle operated trowel 110A is similar to the operation illustrated in FIGS. 10 through 13 but instead the mason 600 kneels on the lawn 642 or 644 and/or on the 2×4 members 630 and 632. This is a more difficult operation because the mason 600 does not have the leverage to pull and push the heavy concrete and throw it away as the mason 600 has when the mason 600 is standing. Therefore, while the hand operated trowel 110A is also within the spirit and scope of the present invention, the pole operated trowel 110 is the preferred embodiment for creating designs into a heavy concrete driveway or other heavy concrete surface.

Figure 17:
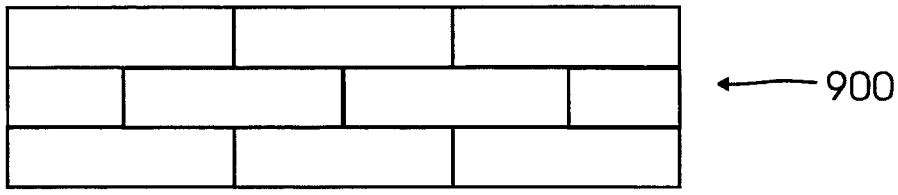
FIG. 17 is a bottom plan view of an alternative embodiment of the present invention concrete trowel with a design formed on the bottom surface.
Figure 18:
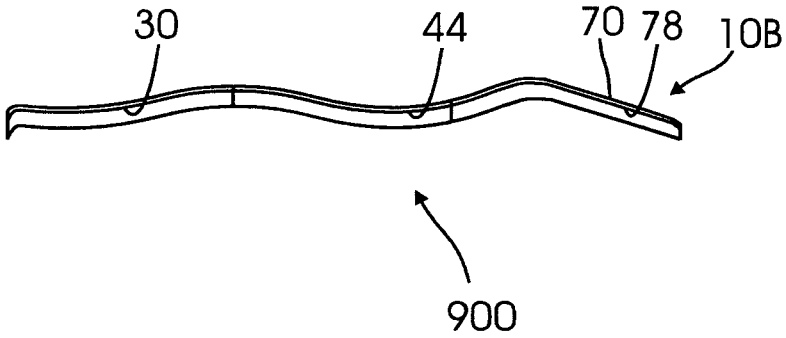
FIG. 18 is a side elevational view of an alternative embodiment of the present invention concrete trowel with a design formed on the bottom surface.
Figure 19:
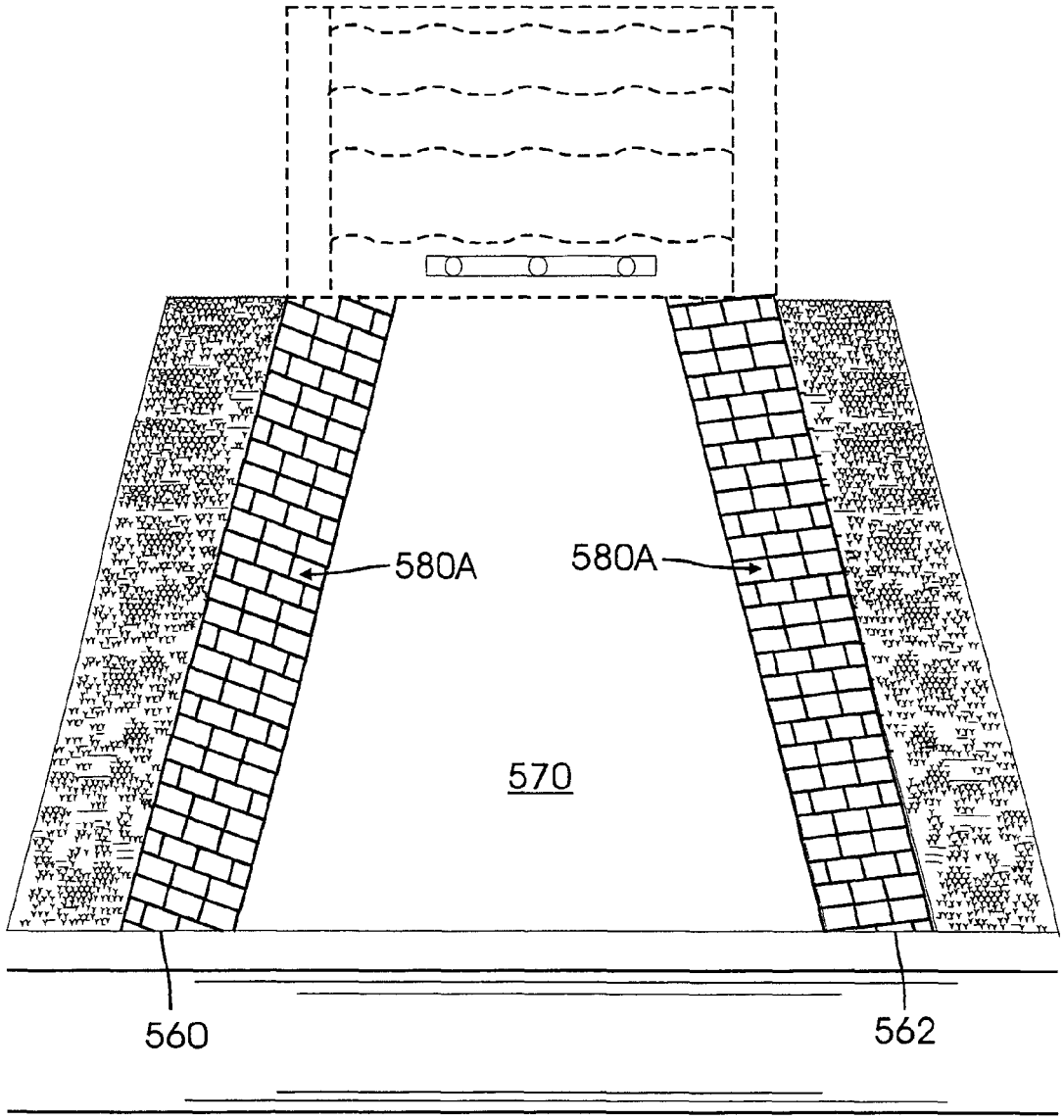
FIG. 19 is a perspective view of the completed driveway with the beautiful alternative embodiment multi-rounded arcuate designs includes a stamped design pattern formed into both side edges of a driveway.

In an additional embellishment to the present invention, the bottom surface of the trowel 10 can have a decorative design formed into the bottom surface of the trowel 10. Therefore, after the operation is completed as illustrated in FIGS. 7 and 14, and while the concrete is still wet, the mason stamps the decorative design into the wet concrete so that the final finished driveway has the decorative design stamped into it and therefore the final driveway has a beautiful rounded design with a decorative design stamped into it. By way of example only, one type of decorative design is a brick pattern 900 as illustrated in FIG. 17. The brick pattern 900 is formed into a second trowel 10B which is the same as trowel 10 however the bottom surfaces 30 and 44 and the bottom surface 78 of the uppermost flat plate section 70 and the locations between these areas on the bottom of the trowel all have the decorative design formed into them. The decorative brick design 900 is illustrated in FIG. 17 and the side view of FIG. 18 shows how the decorative brick design 900 is formed into the underside of the concrete trowel 10B. After the operation to create the rounded design into the driveway is completed, as illustrated in FIG. 7, and while the concrete is still wet, the mason goes to the area adjacent either the street or the garage door and through a vertical downward action, stamps the decorative pattern into the wet concrete, lifts up the trowel 10B and makes another stamping action adjacent the first stamping, and through a repetitive process stamps the brick design 900 into the entire multi-rounded concrete design which was formed on the side edges of the driveway. In addition, the design can also be under the flat plate surface 78 and therefore the design extends into the flat area of the driveway adjacent the multi-rounded design area. The final finished design 580A has the brick pattern formed into both side edges 560 and 562 and also into the driveway 570 in the area adjacent the side edges 560 and 562 as illustrated in FIG. 19. It will be appreciated that the brick design is only one of many numerous designs which can be used, which includes flowers, animals, artwork, etc. The same stamping concept can be formed into other applications of the present invention including flowerbeds and the tabletop as discussed below.

Figure 15:
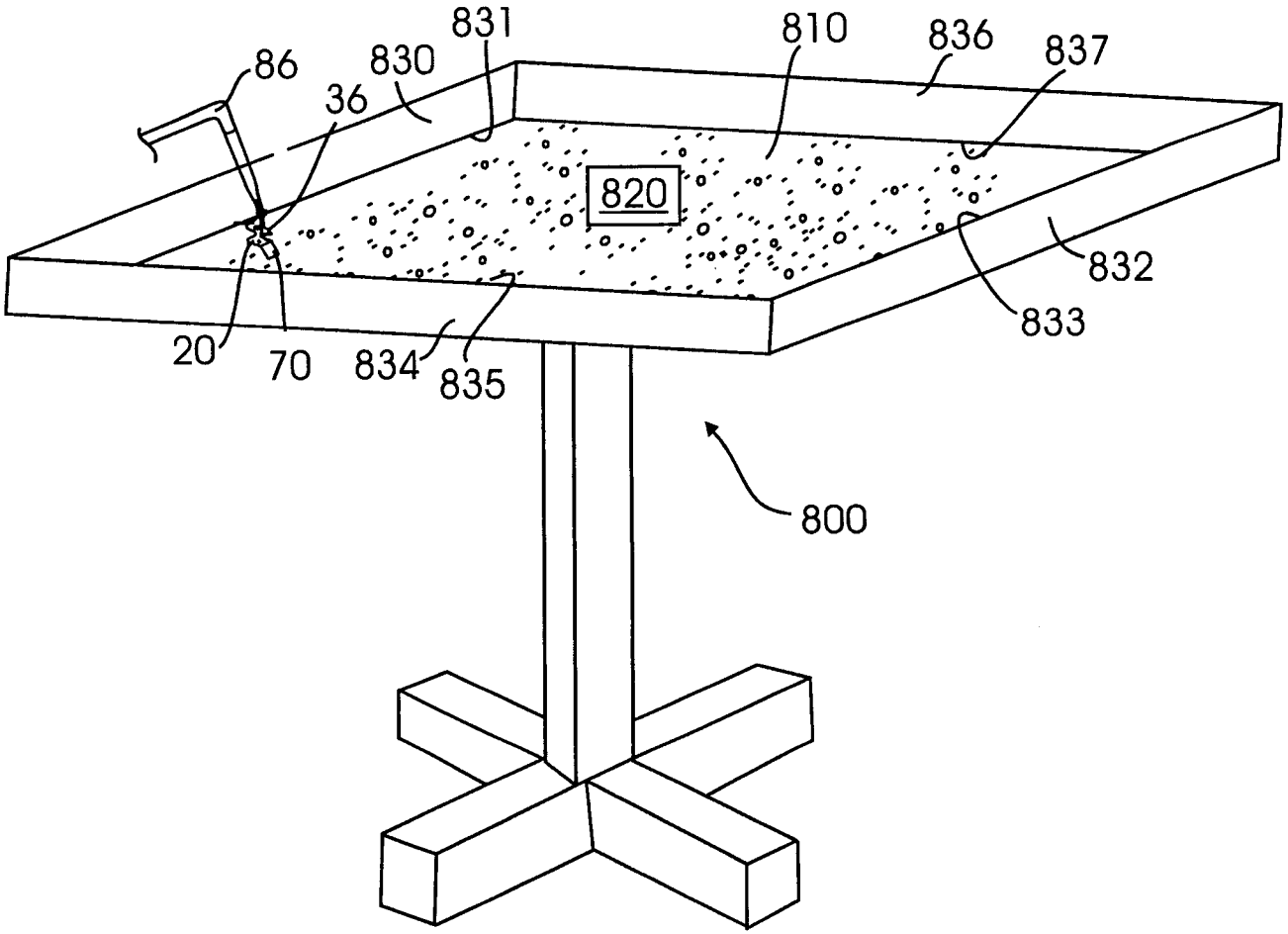
FIG. 15 is a perspective view of a poured concrete slab for a tabletop with one embodiment of the present invention multi-rounded trowel creating a multi-rounded design along the edge of the tabletop.
Figure 16:
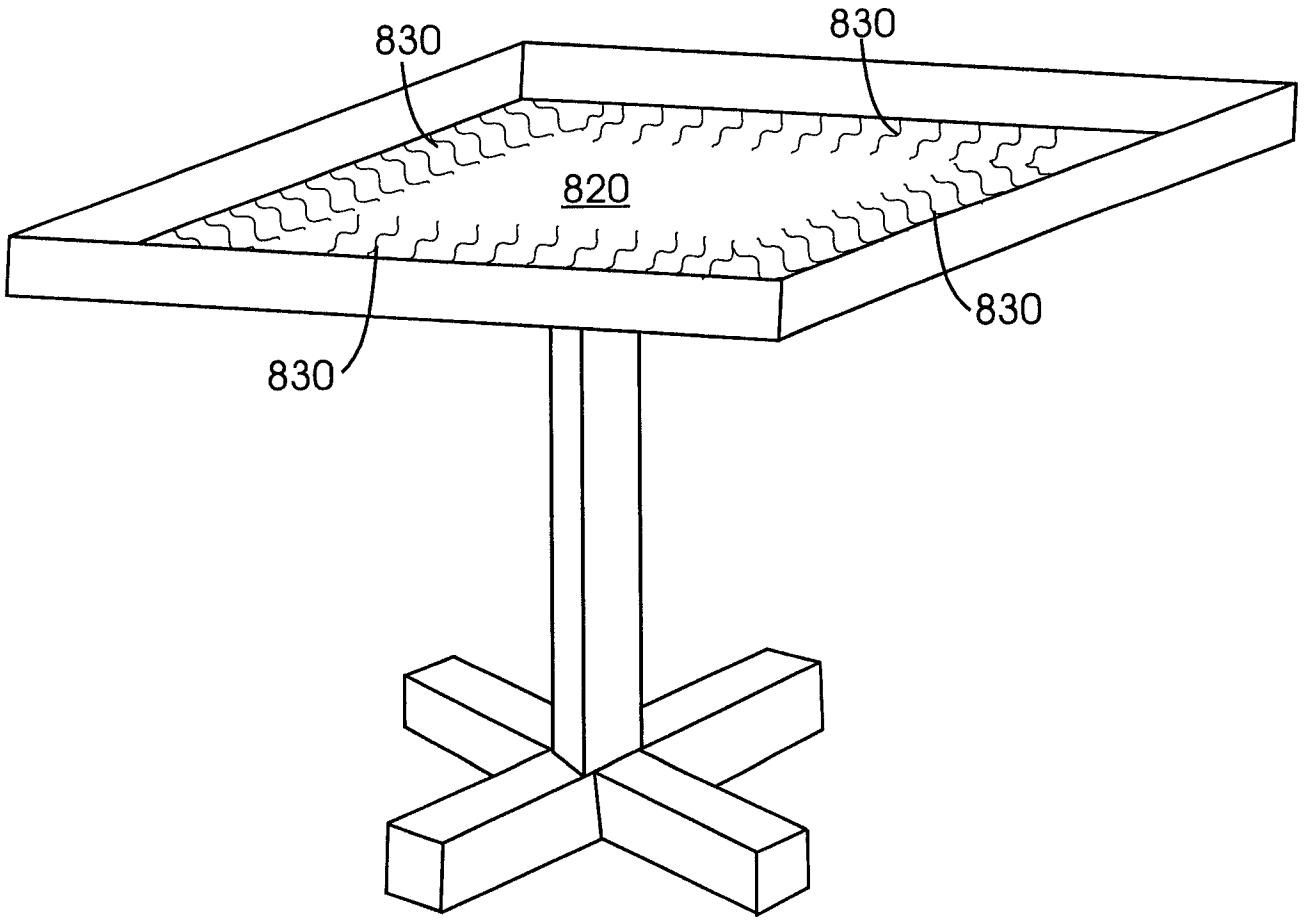
FIG. 16 is a perspective view of a completed concrete tabletop with the multi-rounded design formed along its edges.

It is also possible to use any variation of the present invention to create a multi-rounded edge on a poured concrete tabletop instead of a driveway. As illustrated in FIG. 15, the concrete is poured onto an elevated structure 800 having a smooth flat surface 810 which is surrounded by four 2×4 beams; beam 830 having interior side edge 831, beam 832 having interior side edge 833, beam 834 having interior side edge 835, and beam 836 having interior side edge 837. To form a multi-rounded design onto one or more edges of the concrete tabletop 820, the hand operated version of the trowel such as that illustrated in FIGS. 2 and 9 is used. The outward transverse surface 18 or 118 of lip 12 or 112 is aligned against an interior surface of a beam after the wet concrete tabletop 820 has been poured and the multi-rounded sections 20 or 120 are pushed into the wet concrete tabletop 820 until the bottom surface 78 or 178 or the uppermost flat plate section 70 or 170 rests against the flat top surface 822 of the poured concrete 820. The trowel 10A or 110A is then pulled or pushed through the edge of the concrete with the concrete on top of the trowel being discarded as previously discussed so that the beautiful multi-rounded design 830 is now formed into the edges of the finished tabletop as illustrated in FIG. 16.

Defined in detail, the present invention is a concrete trowel to form a design into at least one edge of a poured concrete structure with the poured concrete structure having an upper surface and at least one outward edge abutting a frame having a transverse side facing the at least one outward edge of the poured concrete structure, the concrete trowel comprising: (a)

a transverse lip having a top edge and a transverse outer surface; (b) a multi-rounded design shaped portion having first and second arcuate surface sections, the first arcuate surface section having a first edge and an opposite second edge, a top rounded surface and a bottom rounded surface, the second arcuate surface section having a first edge and an opposite second edge, a top rounded surface and a bottom rounded surface, the first edge of the first arcuate surface section joined to the top edge of the transverse lip and the second edge of the first arcuate surface section joined to the first edge of the second arcuate surface section; (c) an uppermost flat plate section having a first edge, a top surface and a bottom surface, the first edge of the uppermost flat plate second joined to the second edge of the second arcuate surface section; and (d) means by which the trowel is held attached at a location on at least one upper surface of the first arcuate surface section or the second arcuate surface section or the uppermost flat plate section; (e) whereby, the concrete trowel is pressed into the wet poured concrete at the location of the outward edge such that the transverse outer surface of the transverse lip abuts the transverse side of the frame, the concrete trowel is pushed into the poured concrete to a depth such that the bottom surface of the uppermost flat plate rests on the upper surface of the poured concrete and the first arcuate surface section and section arcuate surface section lie within the poured concrete, the trowel pulled or pushed through the concrete such that the design of the first and second arcuate surface sections is formed into the wet concrete along the at least one outward edge and the concrete resting on the upper surfaces of the first and second arcuate surface sections is discarded, leaving the decorative design formed beneath the bottom surfaces of the first and second arcuate surface sections on the outward edge of the poured concrete structure.

Defined broadly, the present invention is a concrete trowel to form a design into at least one edge of a poured concrete structure with the poured concrete structure having an upper surface and at least one outward edge abutting a frame having a transverse side facing the at least one outward edge of the poured concrete structure, the concrete trowel comprising: (a) a transverse lip having a top edge and a transverse outer surface; (b) a multi-rounded design shaped portion having first, second and third arcuate surface sections, the first arcuate surface section having a first edge and an opposite second edge, a top rounded surface and a bottom rounded surface, the second arcuate surface section having a first edge and an opposite second edge, a top rounded surface and a bottom rounded surface, the third arcuate surface section having a first edge and an opposite second edge, a top rounded surface and a bottom rounded surface, the first edge of the first arcuate surface section joined to the top edge of the transverse lip, the second edge of the first arcuate surface section joined to the first edge of the second arcuate surface section, and the second edge of the second arcuate surface section joined to the first edge of third arcuate surface section; (c) an uppermost flat plate section having a first edge, a top surface and a bottom surface, the first edge of the uppermost flat plate second joined to the second edge of the third arcuate surface section; and (d) means by which the trowel is held attached at a location on at least one upper surface of the first arcuate surface section or the second arcuate surface section or the third arcuate surface section or the uppermost flat plate section; (e) whereby, the concrete trowel is pressed into the wet poured concrete at the location of the outward edge such that the transverse outer surface of the transverse lip abuts the transverse side of the frame, the concrete trowel is pushed into the poured concrete to a depth such that the bottom surface of the uppermost flat plate rests on the upper surface of the poured concrete and the first arcuate surface section, section arcuate surface section and third arcuate surface section lie within the poured concrete, the trowel pulled or pushed through the concrete such that the design of the first, second and third arcuate surface sections is formed into the wet concrete along the at least one outward edge and the concrete resting on the upper surfaces of the first, second and third arcuate surface sections is discarded, leaving the decorative design formed beneath the bottom surfaces of the first, second and third arcuate surface sections on the outward edge of the poured concrete structure.

Defined more broadly, the present invention is a concrete trowel to form a design into at least one edge of a poured concrete structure with the poured concrete structure having an upper surface and at least one outward edge abutting a frame having a transverse side facing the at least one outward edge of the poured concrete structure, the concrete trowel comprising: (a) a transverse lip having a transverse outer surface; (b) a multi-rounded design shaped portion having a multiplicity of aligned arcuate surface sections each having a top surface and a bottom surface and at least one area where one arcuate surface section is adjoined to an adjacent arcuate surface section, the arcuate surface sections combining to form a multi-rounded design, at least one arcuate surface section joined to the transverse lip; (c) an uppermost flat plate section having a top surface and a bottom surface, and joined to one of the arcuate surface sections at a location remote from where an arcuate surface section is joined to the transverse lip; and (d) means by which the trowel is held attached at a location on at least one upper surface of at least one arcuate surface section or on the uppermost flat plate section; (e) whereby, the concrete trowel is pressed into the wet poured concrete at the location of the outward edge such that the transverse outer surface of the transverse lip abuts the transverse side of the frame, the concrete trowel is pushed into the poured concrete to a depth such that the bottom surface of the uppermost flat plate rests on the upper surface of the poured concrete and the multiplicity of arcuate surface sections of the multi-rounded design shaped portion lie within the poured concrete, the trowel pulled or pushed through the concrete such that the design of the multiplicity of arcuate surface sections is formed into the wet concrete along the at least one outward edge and the concrete resting on the upper surfaces of the multiplicity of arcuate surface sections is discarded, leaving the decorative design formed beneath the bottom surfaces of the multiplicity of arcuate surface sections on the outward edge of the poured concrete structure.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A concrete trowel to form a shape into at least one edge of a poured concrete structure with the poured concrete structure having an upper surface and at least one outward edge abutting a frame having a transverse side facing the at least one outward edge of the poured concrete structure, the concrete trowel comprising:

a. a transverse lip having a top edge and a transverse outer surface which engages the traverse side of the abutting frame as a guide;

b. a multi-rounded shape design shaped portion having first, second and third arcuate surface sections, the first arcuate surface section having a first edge and an opposite second edge, a top convex rounded surface and a bottom concave rounded surface, the second arcuate surface section having a first edge and an opposite second edge, a top concave rounded surface and a bottom convex rounded surface, the third arcuate surface section having a first edge and an opposite second edge, a top convex rounded surface and a bottom concave rounded surface, the first edge of the first arcuate surface section joined to the top edge of the transverse lip, the second edge of the first arcuate surface section joined to the first edge of the second arcuate surface section, and the second edge of the second arcuate surface section joined to the first edge of third arcuate surface section;

c. an uppermost flat plate section having a first edge, a top surface and a bottom surface, the first edge of the uppermost flat plate section joined to the second edge of the third arcuate surface section;

d. means by which the trowel is held attached at a location on at least one upper surface of the first arcuate surface section or the second arcuate surface section or the third arcuate surface section or the uppermost flat plate section; and e. the multi-rounded shape design of the concrete trowel is formed to be used in conjunction with an upper surface of a poured wet concrete structure at a location where at least one outward edge of the poured wet concrete structure abuts a frame, the transverse lip formed to be used in conjunction with the at least one outward edge of the poured wet concrete so that the transverse lip abuts a transverse side of the frame adjacent the outward edge of the poured wet concrete, and after the concrete trowel is pushed into the poured wet concrete to a depth that the bottom surface of the uppermost flat plate rests on the upper surface of the poured wet concrete and the first arcuate surface section, second arcuate surface section and third arcuate surface section lie within the poured wet concrete, the trowel is used in conjunction with the poured wet concrete by being pulled or pushed through the poured wet concrete such that the multi-rounded shape design of the first, second and third arcuate surface sections of the concrete trowel is formed into the poured wet concrete along at least one outward edge and the concrete resting on the upper surfaces of the first and second arcuate surface sections is discarded, leaving the multi-rounded shape design formed beneath the bottom surfaces of the first, second and third arcuate surface sections on an upper surface of the outward edge of the poured wet concrete structure.

2. The concrete trowel in accordance with claim 1, wherein the means by which the trowel is held is a pole attachment means affixed to the concrete trowel and having means to receive a pole.

3. The concrete trowel in accordance with claim 1, wherein the means by which the trowel is held is a single handle affixed to the concrete trowel.

4. A concrete trowel to form a shape into at least one edge of a poured concrete structure with the poured concrete structure having an upper surface and at least one outward edge abutting a frame having a transverse side facing the at least one outward edge of the poured concrete structure, the concrete trowel comprising:

a. a transverse lip having a top edge and a transverse outer surface which engages the traverse side of the abutting frame as a guide;

b. a multi-rounded shape design shaped portion having first, second and third arcuate surface sections, the first arcuate surface section having a first edge and an opposite second edge, a top concave rounded surface and a bottom convex rounded surface, the second arcuate surface section having a first edge and an opposite second edge, a top convex rounded surface and a bottom concave rounded surface, the third arcuate surface section having a first edge and an opposite second edge, a top concave rounded surface and a bottom convex rounded surface, the first edge of the first arcuate surface section joined to the top edge of the transverse lip, the second edge of the first arcuate surface section joined to the first edge of the second arcuate surface section, and the second edge of the second arcuate surface section joined to the first edge of third arcuate surface section;

c. an uppermost flat plate section having a first edge, a top surface and a bottom surface, the first edge of the uppermost flat plate section joined to the second edge of the third arcuate surface section;

d. means by which the trowel is held attached at a location on at least one upper surface of the first arcuate surface section or the second arcuate surface section or the third arcuate surface section or the uppermost flat plate section; and e. the multi-rounded shape design of the concrete trowel is formed to be used in conjunction with an upper surface of a poured wet concrete structure at a location where at least one outward edge of the poured wet concrete structure abuts a frame, the transverse lip formed to be used in conjunction with the at least one outward edge of the poured wet concrete so that the transverse lip abuts a transverse side of the frame adjacent the outward edge of the poured wet concrete, and after the concrete trowel is pushed into the poured wet concrete to a depth that the bottom surface of the uppermost flat plate rests on the upper surface of the poured wet concrete and the first arcuate surface section, second arcuate surface section and third arcuate surface section lie within the poured wet concrete, the trowel is used in conjunction with the poured wet concrete by being pulled or pushed through the poured wet concrete such that the multi-rounded shape design of the first, second and third arcuate surface sections of the concrete trowel is formed into the poured wet concrete along at least one outward edge and the concrete resting on the upper surfaces of the first and second arcuate surface sections is discarded, leaving the multi-rounded shape design formed beneath the bottom surfaces of the first, second and third arcuate surface sections on an upper surface of the outward edge of the poured wet concrete structure.

5. The concrete trowel in accordance with claim 4, wherein the means by which the trowel is held is a pole attachment means affixed to the concrete trowel and having means to receive a pole.

6. The concrete trowel in accordance with claim 4, wherein the means by which the trowel is held is a single handle affixed to the concrete trowel.

* * * * *